US007493925B2

(12) United States Patent
Bae

(10) Patent No.: US 7,493,925 B2
(45) Date of Patent: Feb. 24, 2009

(54) CABLE TIE CUTTING METHOD AND CABLE TIE CUTTER EXECUTING THE METHOD

(75) Inventor: Jun-Jib Bae, Seoul (KR)

(73) Assignee: Dong-A Bestech Co., Ltd., Buchon (KR)

( * ) Notice: Subject to any disclaimer, the term of this patent is extended or adjusted under 35 U.S.C. 154(b) by 0 days.

(21) Appl. No.: 11/797,811

(22) Filed: May 8, 2007

(65) Prior Publication Data

US 2007/0267085 A1 Nov. 22, 2007

(30) Foreign Application Priority Data

May 19, 2006 (KR) ..... 10-2006-0045065

(51) Int. Cl.
*B21F 9/00* (2006.01)

(52) U.S. Cl. ..... 140/123.6; 140/93.2

(58) Field of Classification Search ..... 140/93 R, 140/93.2, 123.6, 93 A, 49, 93.4, 93.6
See application file for complete search history.

(56) References Cited

U.S. PATENT DOCUMENTS 4,997,011 A * 3/1991 Dyer et al. ..... 140/93.2
6,206,053 B1 * 3/2001 Hillegonds ..... 140/123.6

* cited by examiner

*Primary Examiner*—Dana Ross
*Assistant Examiner*—Debra M Sullivan
(74) *Attorney, Agent, or Firm*—Kratz, Quintos & Hanson, LLP

(57) ABSTRACT

A cable tie cutting method and a cable tie cutter Includes pressing a trigger lever backwards such that a cable tie traction means draws the cable tie backwards until tightened; pressing the trigger lever backwards, rotating a clutch means into engagement with a cutting means operable in conjunction with the clutch means, and a base block is rotated; a cable tie cutting step of moving the cutting means backwards by the clutch means and operating a cutting blade, and cutting the end of the cable tie; and a returning step such that the clutch means is released from engagement, thus causing the cable tie traction means to be operated in conjunction with the clutch means.

13 Claims, 14 Drawing Sheets

CABLE TIE CUTTING METHOD AND CABLE TIE CUTTER EXECUTING THE METHOD

BACKGROUND OF THE INVENTION

1. Field of the Invention

The present invention relates, in general, to methods and devices for cutting cable ties and, more particularly, to a cable tie cutting method and a cable tie cutter for executing the method, which only require small cutting force during a cable tie cutting process, thus reducing impact applied from the cutter to the wrist and elbow of a user when cutting cable ties, so that the user can easily and conveniently cut the cable ties and the wrist and elbow of the user are protected from overload and overstress, and thus the user can avoid workmen's accident on the wrist and elbow.

2. Description of the Related Art

Generally, as shown in FIG. 1, to cut a cable tie using a conventional cable tie cutter, a user presses a trigger lever 92 of the cutter backwards by fingers such that a cable tie holder 91 of the cutter, which holds a cable tie, is retracted along with the cable tie and draws the cable tie backwards. When the cable tie is fully drawn backwards by the holder 91 and is completely tightened, the cable tie holder 91 is not further retracted, so that the trigger lever 92, which has been pressed by the fingers of the user to tighten the cable tie, is tensioned and is not likely to be further moved backwards. Thus, in the above state, the user must press the trigger lever 92 backwards with increased force so as to move the lever 92. To cut the cable tie after completely tightening the cable tie, a cable tie cutting blade 93 must be operated. To operate the cable tie cutting blade 93, an actuating link 94 must be actuated by a triangular link 96, which is rotated counterclockwise around a hinge pin 95, acting as a hinge shaft, and escapes from a spring-biased base block 98, which is biased by a return spring 97. Thus, in the above state, the user must press the trigger lever 92 backwards by his/her fingers with strong power such that the muscles of the wrist, elbow and hand of the user are overloaded and overstressed when the user repeats the cable tie cutting work. Particularly, when the user presses the lever 92 by fingers with strong power such that the lower end of the triangular link 96, which has been stopped by a stop protrusion 98*a* of the base block 98, can quickly pass over the stop protrusion 98*a* and then collides on the rear wall of the cutter grip, strong impact is applied from the grip to the user. Thus, when the user has worked with the conventional cable tie cutter for a lengthy period of time, the user may suffer from damage to the wrist and elbow joints and may meet with workmen's accident. Further, just after the user cuts a cable tie using the conventional cable tie cutter with strong grasping power, a restoring force, is applied from a return spring 99 to the cutter to elastically return the trigger lever 92 to its original position, so that the damage to the wrist and elbow joints of the user becomes worse by impact induced from the restoring force.

SUMMARY OF THE INVENTION

Accordingly, the present invention has been made keeping in mind the above problems occurring in the related art, and an object of the present invention is to provide a cable tie cutting method, which minimizes impact applied from a cutter to the elbow and wrist of a user when cutting a cable tie, thus allowing the user to easily and conveniently cut the cable tie.

Another object of the present invention is to provide a cable tie cutter, which minimizes impact applied to the elbow and wrist of a user when cutting a cable tie, thus allowing the user to easily and conveniently cut the cable tie.

In order to achieve the above objects, according to one aspect of the present invention, there is provided a cable tie cutting method of inserting an end of a cable tie into a cable tie cutter and repeatedly pressing a trigger lever of the cutter backwards, thus cutting the end of the cable tie, the method comprising: a cable tie tightening step of repeatedly pressing the trigger lever backwards such that a cable tie traction means, which holds the cable tie, is repeatedly moved backwards, thus drawing the cable tie backwards until the cable tie is tightened to realize a predetermined tightened state thereof; a cable tie cutting preparation step of pressing the trigger lever backwards, thus rotating a clutch means such that the clutch means is released from engagement with the cable tie traction means and is brought into engagement with a cutting means so that the cutting means is operable in conjunction with the clutch means, and a base block is rotated, thus realizing an operational preparation state of the cutting means; a cable tie cutting step of pressing the trigger lever backwards, thus moving the cutting means backwards by the clutch means and operating a cutting blade of the cutting means, and cutting the end of the cable tie by the cutting blade; and a returning step of returning the clutch means to an original state thereof, after cutting the end of the cable tie, such that the clutch means is released from engagement with the cutting means and is brought into engagement with the cable tie traction means such that the cable tie traction means is operated in conjunction with the clutch means.

In another aspect, the present invention provides a cable tie cutter, comprising: a trigger lever rotatably mounted at an upper end thereof to a cutter casing by a hinge and pressed backwards; a cable tie traction means coupled to the trigger lever such that the cable tie traction means is operated in conjunction with the trigger lever, the cable tie traction means holding a cable tie and drawing the cable tie backwards to tighten the cable tie; a clutch means operated in conjunction with the cable tie traction means and temporarily stopping the operation of the cable tie traction means when the cable tie is fully drawn and tightened; and a cutting means selectively coupled to the clutch means such that the cutting means is operated in conjunction with the clutch means when the clutch means is released from engagement with the cable tie traction means, the cutting means cutting the cable tie when the trigger lever is pressed backwards, and, thereafter, the cutting means being released from cooperation with the trigger lever.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
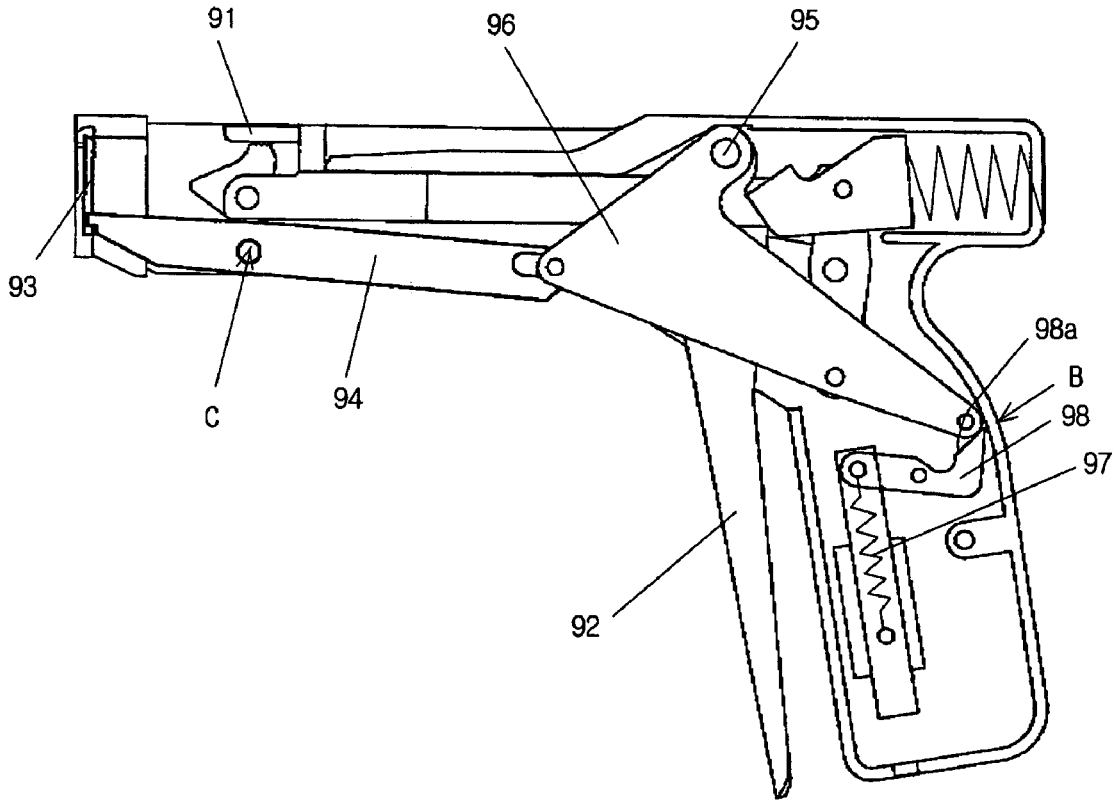
FIG. 1 is a front view of a conventional cable tie cutter, from which a cover is removed.
Figure 2:
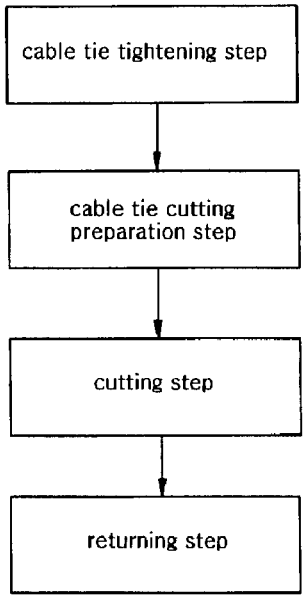
FIG. 2 is a diagram schematically illustrating a process of executing a cable tie cutting method according to the present invention.
Figure 3:
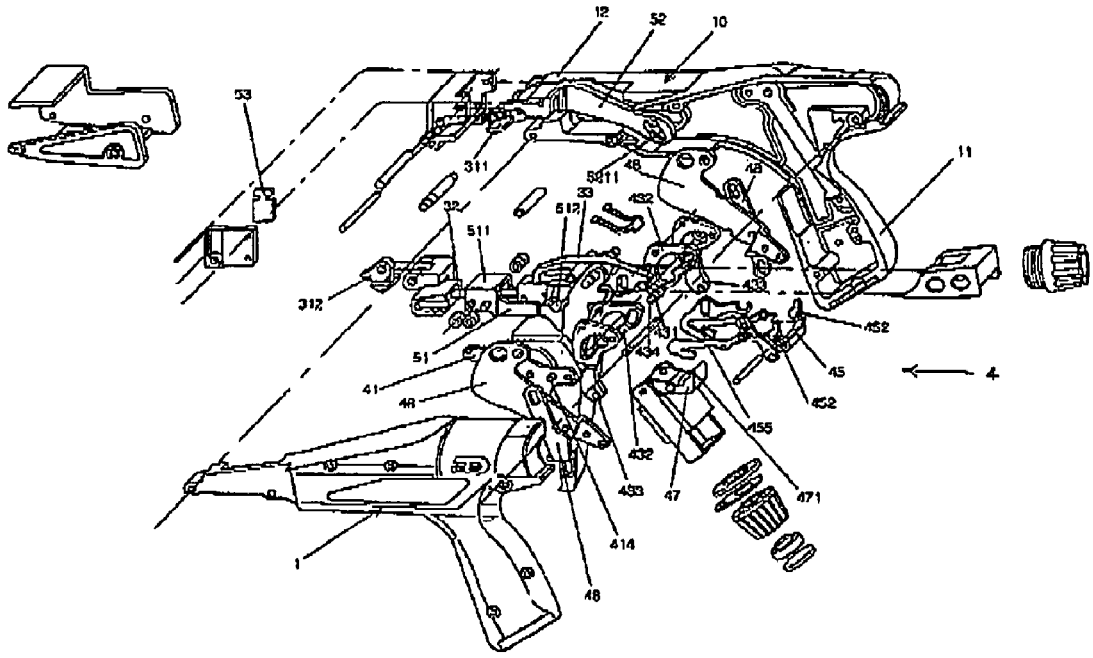
FIG. 3 is an exploded perspective view illustrating the construction of a cable tie cutter according to the present invention.
Figure 4:
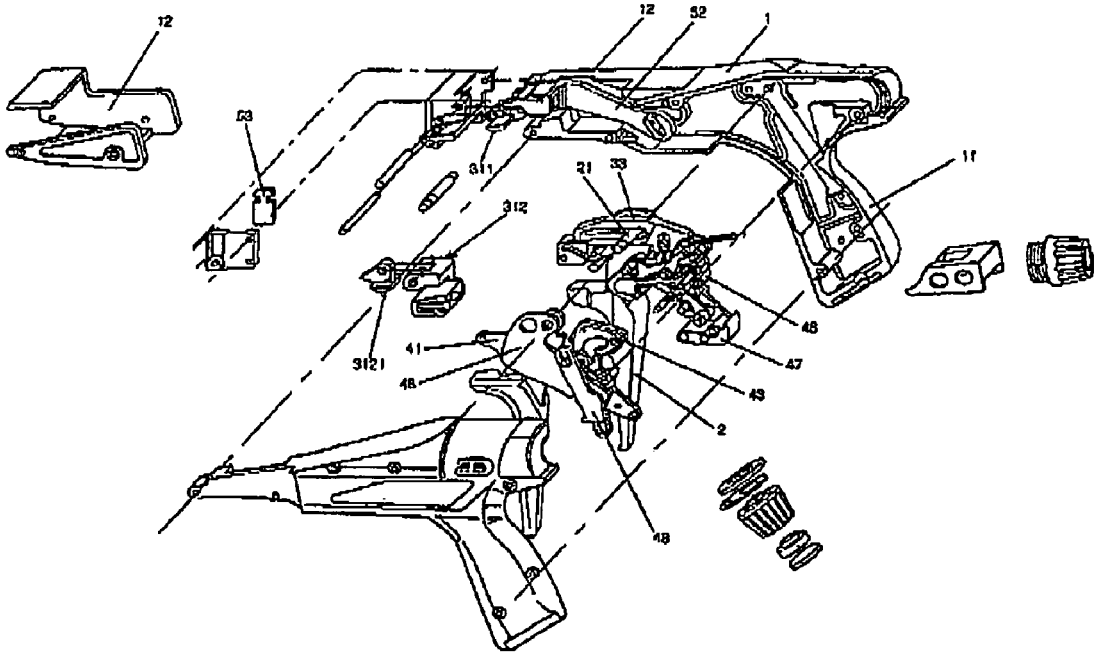
FIG. 4 is an exploded perspective view illustrating the assembled state of some elements of the cable tie cutter according to the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

A cable tie cutting method according to the present invention comprises: a cable tie tightening step of inserting an end of a cable tie into a cable tie cutter and pressing a trigger lever backwards by fingers of a user such that a cable tie traction means, which holds the cable tie, is moved backwards, thus drawing the cable tie backwards until the cable tie is tightened to realize a predetermined tightened state thereof; a cable tie cutting preparation step of pressing the trigger lever backwards by the fingers of the user after tightening the cable tie, thus releasing the cable tie traction means from the trigger lever such that the backward movement of the cable tie traction means is stopped, and bringing a clutch means, which is operated in conjunction with the trigger lever, into engagement with a cutting means; a cutting step of pressing the trigger lever backwards by the fingers of the user, thus moving a cutting blade of the cutting means downwards or upwards and cutting the end of the cable tie; and a returning step of releasing the cutting means from engagement with the clutch means after cutting the cable tie and returning the clutch means to the original state thereof, in which the clutch means is brought into engagement with the cable tie traction means, thus allowing the cable tie traction means is operable in conjunction with the trigger lever.

Figure 14:
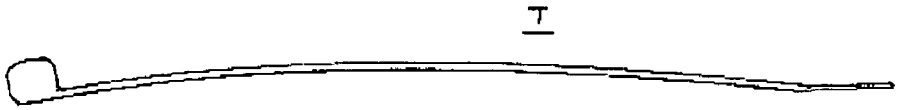
FIG. 14 illustrates a cable tie.

As shown in FIG. 3 through FIG. 10, the cable tie cutter A according to the present invention comprises: a trigger lever 2, which is rotatably mounted at the upper end thereof to a cutter casing 1 by a hinge and is pressed backwards by fingers of a user; a cable tie traction means 3, which is coupled to the trigger lever 2 such that the traction means 3 is operated in conjunction with the trigger lever 2, and holds a cable tie T (shown in FIG. 14) and draws the cable tie T backwards to substantially tighten the cable tie T; a clutch means 4, which is operated in conjunction with the cable tie traction means 3 and temporarily stops the operation of the cable tie traction means 3 when the cable tie T is fully drawn and tightened; and a cutting means 5, which is operated in conjunction with the clutch means 4 when the cable tie T is fully drawn and tightened by the cable tie traction means 3 and the clutch means 4 temporarily stops the operation of the cable tie traction means 3, in which the cutting means 5 cuts the cable tie T when the trigger lever 2 is operated, and, thereafter, is released from the cooperation with the trigger lever 2.

The cutter casing 1 has a pistol shape comprising a grip 11 and a barrel 12 such that the cutter can be easily gripped and handled by one hand of a user.

The trigger lever 2 is rotatably mounted at the upper end thereof to the cutter casing 1 by a hinge shaft 21 such that the lever 2 is rotated forwards and backwards in front of the grip 11 of the cutter casing 1. The middle portion of the upper part of the trigger lever 2 is coupled to a clutch means 4 using a hinge pin 22.

The cable tie traction means 3 comprises a cable tie holder 31, which is installed in the front part of the barrel 12 of the cutter casing 1 and holds a cable tie, and a traction tension block 33, which is connected to the cable tie holder 31 through a shaft 32 such that the block 33 is moved forwards and backwards. The traction tension block 33 is provided with a horizontal slide hole 331 on the middle part thereof. A connection hole 332 is formed on the rear part of the traction tension block 33 so that the traction tension block 33 is connected to the clutch means 4, with a beak part 333 formed on the rear end of the traction tension block 33 such that the beak part 333 detachably engages with the clutch means 4.

Figure 5:
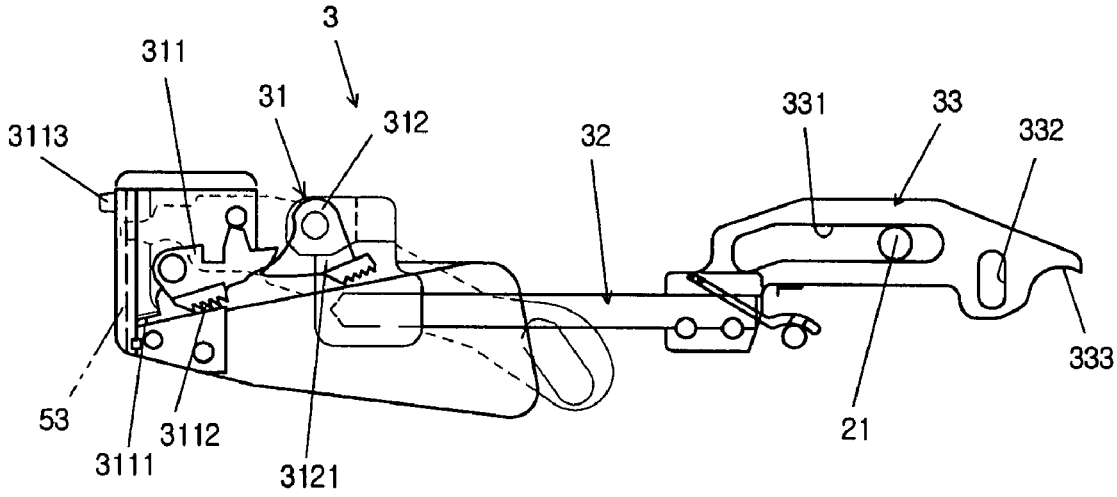
FIG. 5 is a front view of a traction means of the cable tie cutter according to the present invention.

As shown in FIG. 5, the cable tie holder 31 of the cable tie traction means 3 comprises a fixed cable tie holder 311, which is installed in the front part of the cable tie holder 31, and a movable cable tie holder 312, which is installed in parallel to the fixed cable tie holder 311 such that the movable cable tie holder 312 is moved forwards and backwards. The fixed cable tie holder 311 is provided in the lower part thereof with an insertion slot 3111 to receive the cable tie T therein. A spring-biased ratch 3112 is provided in back of the insertion slot 3111 at a location near the slot 3111, with teeth formed along the lower edge of the ratch 3112. An actuating protrusion 3113 is provided in the upper portion of the front part of the fixed cable tie holder 311 and pushes a ball stopper of the cable tie T forwards. A cutting blade 53 is movably provided in the fixed cable tie holder 311 such that the blade 53 is moved upwards and downwards to cut the cable tie T. The movable cable tie holder 312 is movably installed in the cable tie traction means 3 such that it is in contact with the fixed cable tie holder 311. A spring-biased ratch 3121 is provided in the movable cable tie holder 312 with teeth formed along the lower edge of the ratch 3121. The movable cable tie holder 312 is moved forwards and backwards by a forward/backward movable shaft 32. When the movable cable tie holder 312 is brought into contact with the fixed cable tie holder 311, the ratch 3121 is raised upwards so that the ratch 3121 does not hold the cable tie T. However, when movable cable tie holder 312 is moved backwards, it is separated from the fixed cable tie holder 311. In the above state, the ratch 3121 is biased by the spring, thus holding and drawing the cable tie T. The traction tension block 33, which is fixed to the second end of the shaft 32, is provided with a connection hole 332 in the rear part thereof and is connected to the clutch means 4 in the connection hole 332 such that the tension block 33 can be moved forwards and backwards in conjunction with the operation of the clutch means 4.

The clutch means 4 comprises: a clutch connection plate 41, which is rotatably connected to the trigger lever 2 by a hinge pin 22 and is operated in conjunction with the lever 2; a clutch assembly 43, which has an actuation hole 44 and is connected to the clutch connection plate 41 by inserting an actuation pin 42, provided on the rear part of the clutch connection plate 41, into the actuation hole 44, thus being operated in conjunction with the clutch connection plate 41; a combination hook 45, which is rotatably mounted to the cutter casing 1 by a hinge and has a specifically curved edge to be operated in conjunction with a first protrusion 411 provided in the rear part of the clutch connection plate 41; and a base plate 46, which is connected at a first end thereof to the hinge shaft 21, is mounted at a second end thereof to the cutter casing 1 such that it is in close contact with a base block 47, and is hinged to the clutch assembly 43 at a middle portion thereof.

The clutch connection plate 41 comprises two plates 41, which are parallely arranged in the casing 1 such that the plates 41 cover both the lever 2 and the traction tension block 33 at locations outside them. Each of the two clutch connection plates 41 comprises an arcuate actuation hole 412, which extends in a direction perpendicular to the axis of the plate 41. A link pin 413 is inserted into the actuation hole 412. A second protrusion 414 is projected outwards at a location between the hinge pin 22 and the actuation pin 42.

Figure 6:
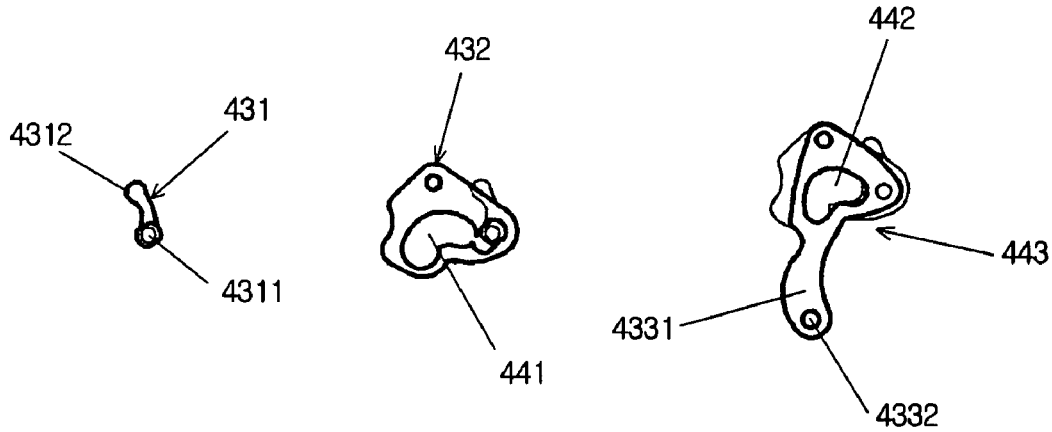
FIG. 6 is a front view of exploded elements of a clutch assembly, which constitutes the cable tie cutter according to the present invention.
Figure 7:
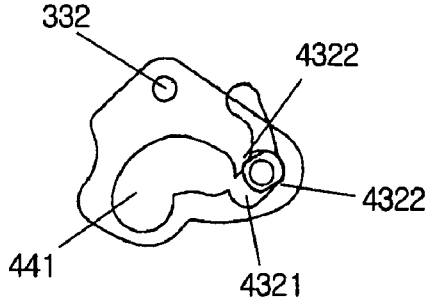
FIG. 7 is a front view of a clutch disc, in which a clutch link of the clutch assembly is installed.

As shown in FIG. 6, the clutch assembly 43 comprises: a clutch link 431, which is detachably connected to the beak part 333 of the traction tension block 33; two clutch discs 432, which are oppositely placed outside the clutch link 431 to cover the link 431, with a first actuation hole 441 having a reversed heart shape formed in the middle portion of each of the two discs 432; and two clutch housings 433, which are oppositely placed outside the clutch discs 432 to cover the discs 432, with a second actuation hole 442 having a reversed heart shape formed in the middle portion of each of the two housings 433 and an extension part 4331 extending downwards from the lower end of each clutch housing 433 and hinged to an associated base plate 46 by a hinge pin 4332. The clutch link 431, the clutch discs 432 and the clutch housings 433 are connected to each other by a hinge shaft 434. The upper parts of both the clutch discs 432 and the clutch housings 433 are connected to the traction tension block 33 by a connection shaft 435, which is inserted into a connection hole 332 of the traction tension block 33, so that the clutch discs 432 and the clutch housings 433 are operated in conjunction with the traction tension block 33.

Figure 8:
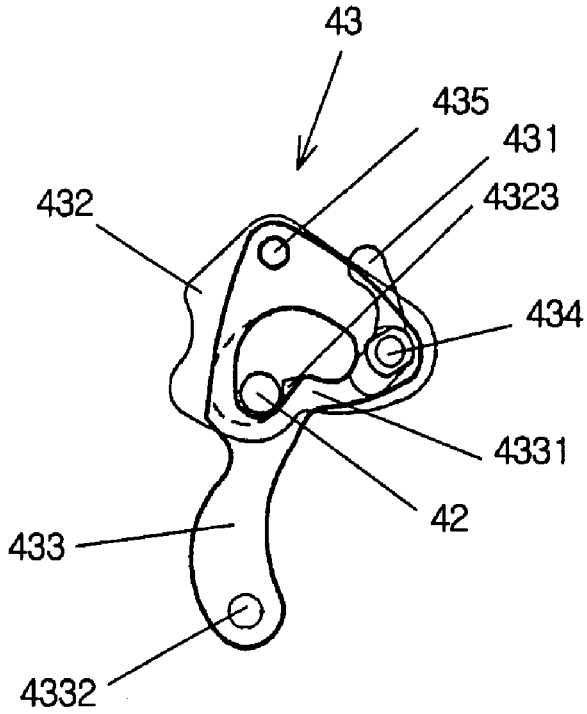
FIG. 8 is a front view illustrating the operation of the clutch assembly according to the present invention.

A slide hole 4321 is formed through the clutch disc 432 of the clutch assembly 43 such that it communicates with the first actuation hole 441, with a switch protrusion 4311 provided on the lower end of the clutch link 431 and connected to the slide hole 4321. A stop hole 4322 is formed above the slide hole 4321 and is connected to the switch protrusion 4311 of the clutch link 431. In the state wherein the clutch means 4 normally tracts the traction tension block 33, as shown in FIG. 8, the first and second actuation holes 441 and 442 of the clutch discs 432 and the clutch housings 433 of the clutch assembly 43 are located such that they are offset from each other, so that a stop protrusion 4323, which is provided on the edge of the first actuation hole 441 of the clutch disc 432, projects closer to the actuation pin 42 rather than the extension part 4331 of the clutch housing 433. Further, the link head 4312 of the clutch link 431 projects outside the upper edge of the clutch disc 432. The switch protrusion 4311 is locked to the stop hole 4322 of the slide hole 4321 of the clutch disc 432. In the above-mentioned state, the rotating motion of the clutch disc 432 is stopped, the tightening operation for the cable tie T is finished, as will be described in detail later herein. Thus, the switch protrusion 4311 of the clutch link 431 is released from the stop hole 4322 of the slide hole 4321, so that the clutch disc 432 can be rotated.

The actuation pin 42, which makes the clutch connection plate 41 and the clutch assembly 43 be operated in conjunction with each other, is placed on the lower edge of the reversed heart-shaped actuation hole 44 and moves in the actuation hole 44 to cause the clutch means 4 to be operated in conjunction with or released from the tie traction means 3.

The combination hook 45 is rotated around the hinge pin 451 and has two extension parts 452, which extend upwards from opposite ends of the hook 45, so that the hook 45 can be operated in conjunction with the first protrusion 411, which is provided in the rear part of the clutch connection plate 41. Further, a protrusion jaw 4521 is provided on the curved edge 4520 of each extension part 452, which comes into contact with the first protrusion 411. A cooperation plate 455 is connected to a middle portion of the combination hook 45 and causes the combination hook 45 to be operated in conjunction with the cutting means 5. During the cable tie drawing process, the combination hook 45 comes into contact with the lower end of the curved edge 4520. However, during a cable tie cutting preparation process and the cable tie cutting process, the first protrusion 411 is placed on the protrusion jaw 4521 of the combination hook 45.

Figure 9:
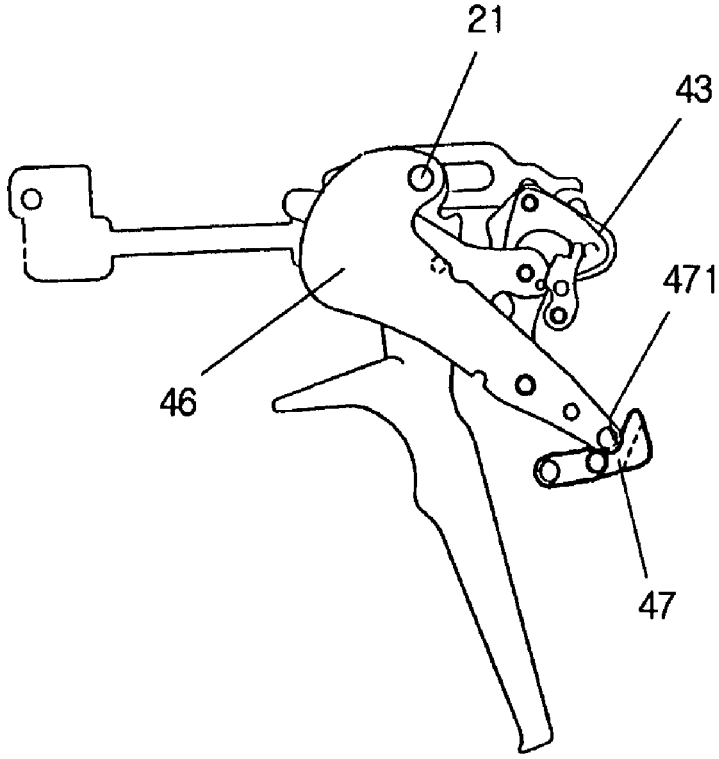
FIG. 9 is a front view illustrating the construction of the clutch assembly according to the present invention.

As shown in FIG. 9, the first end of the base plate 46 is connected to the hinge shaft 21, while the second end of the base plate 46 is connected to the cutter casing 1 such that the second end is in close contact with a stop slot 471 of the base block 47. The middle portion of the base plate 46 is hinged to the clutch housing 433 of the clutch assembly 43. The base block 47 is hinged by a hinge shaft 473 and is elastically biased by a tension spring 472 such that it elastically biases the lower end of the base plate 46 upwards.

Figure 10:
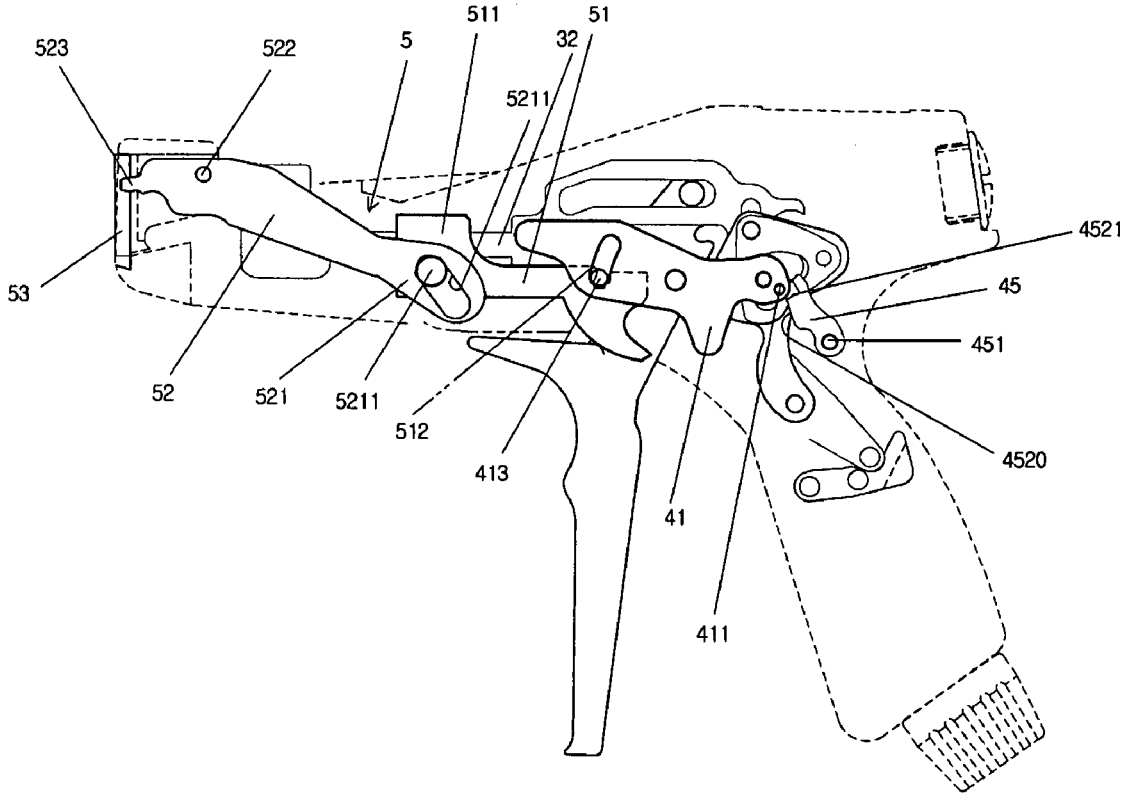
FIG. 10 is a front view illustrating the construction of a cutting means of the cable tie cutter according to the present invention.

As shown in FIG. 10, the cutting means 5 comprises a movable carrier 51, an actuation link 52 and a cutting blade 53. The shaft 32 passes through the first end of the carrier 51 such that the carrier 51 moves along the shaft 32. A guide 511, having a protruding bearing 5111, is formed on the side surface of the carrier 51. A guide hole 512, which is open at the upper end thereof, is formed on the second end of the carrier 51 such that the link pin 413 of the clutch connection plate 41 is inserted into or removed from the guide hole 512. The actuation link 52 comprises a sliding part 521, which is provided on the first end of the link 52 and has an inclined sliding hole 5211 to movably receive therein the bearing 5111 of the guide 511. The second end of the actuation link 52 is provided with a locking protrusion 523, which is movable in a vertical direction and engages with the cutting blade 53 which is movably installed in the fixed cable tie holder 311. A locking protrusion 523 is provided on the middle portion of the actuation link 52 and is hinged to the cutter casing 1 by a hinge pin 522. The cutting blade 53 is moved in a vertical direction in response to upward or downward movement of the actuation link 52.

The cable tie cutter according to the present invention having the above-mentioned construction is operated as follows.

Figure 11A:
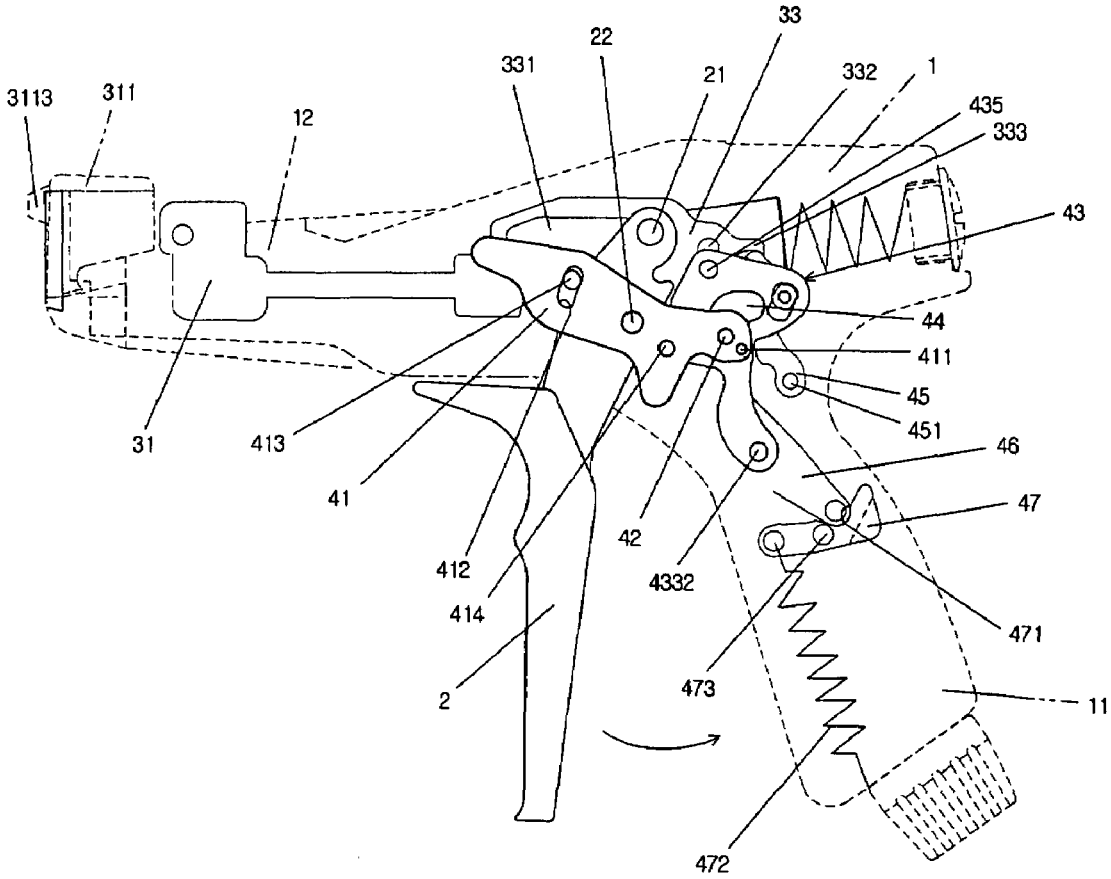
FIGS. 11*a*, 11*b* and 11*c* are views illustrating the operation of the clutch assembly according to the present invention when the cable tie cutter executes a cable tie tightening process.
Figure 11B:
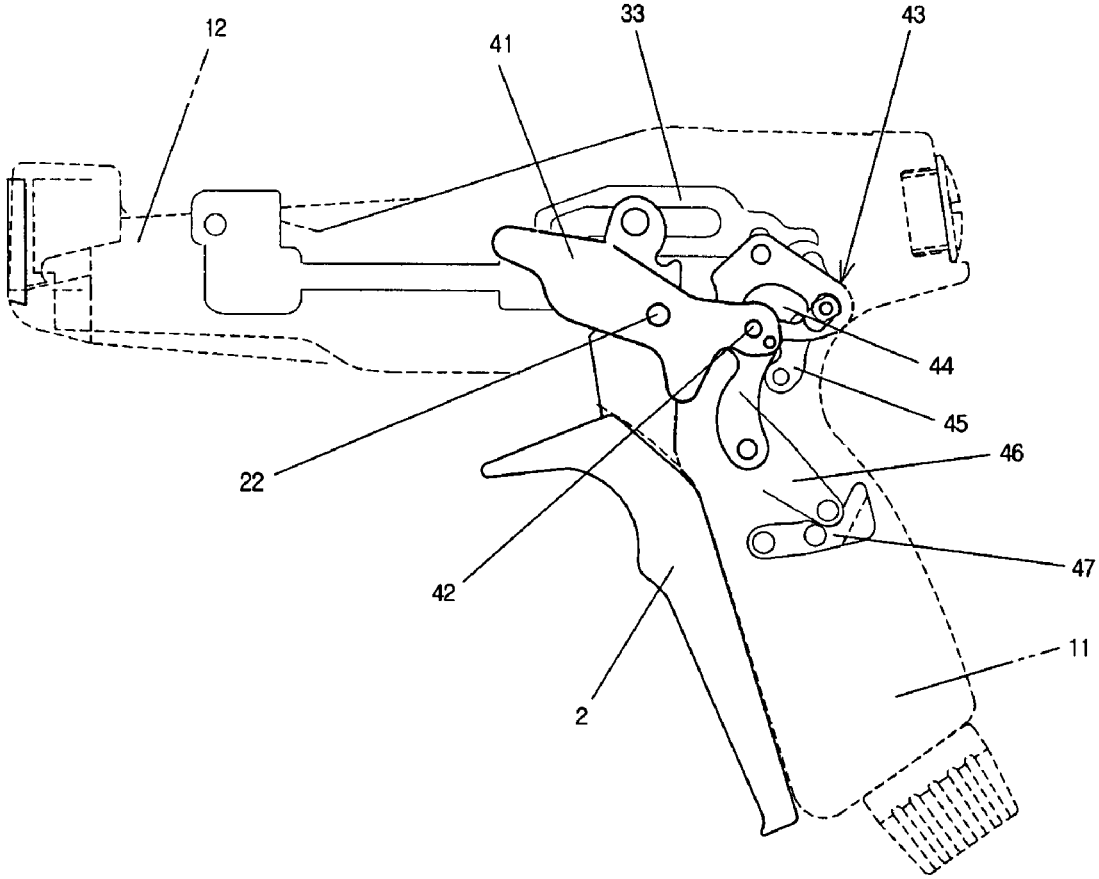
Figure 11C:
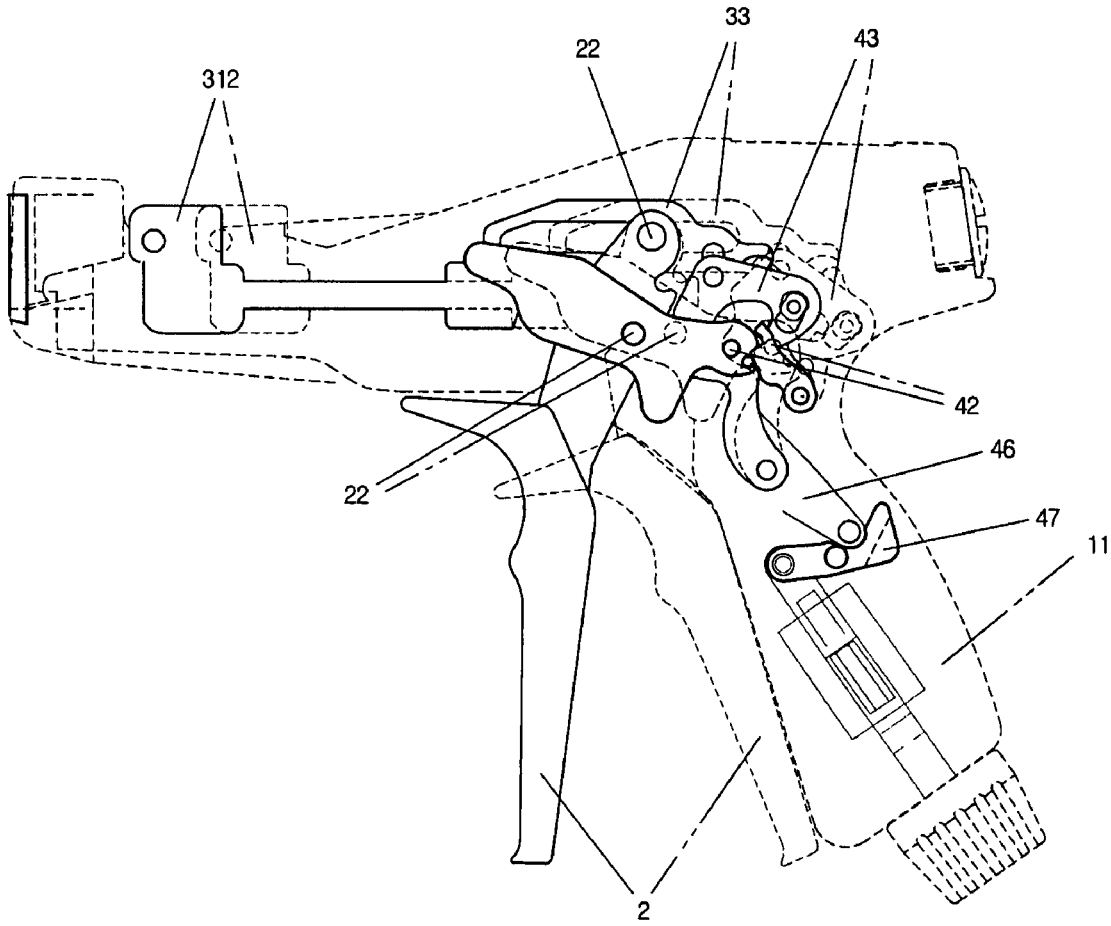
Figure 12A:
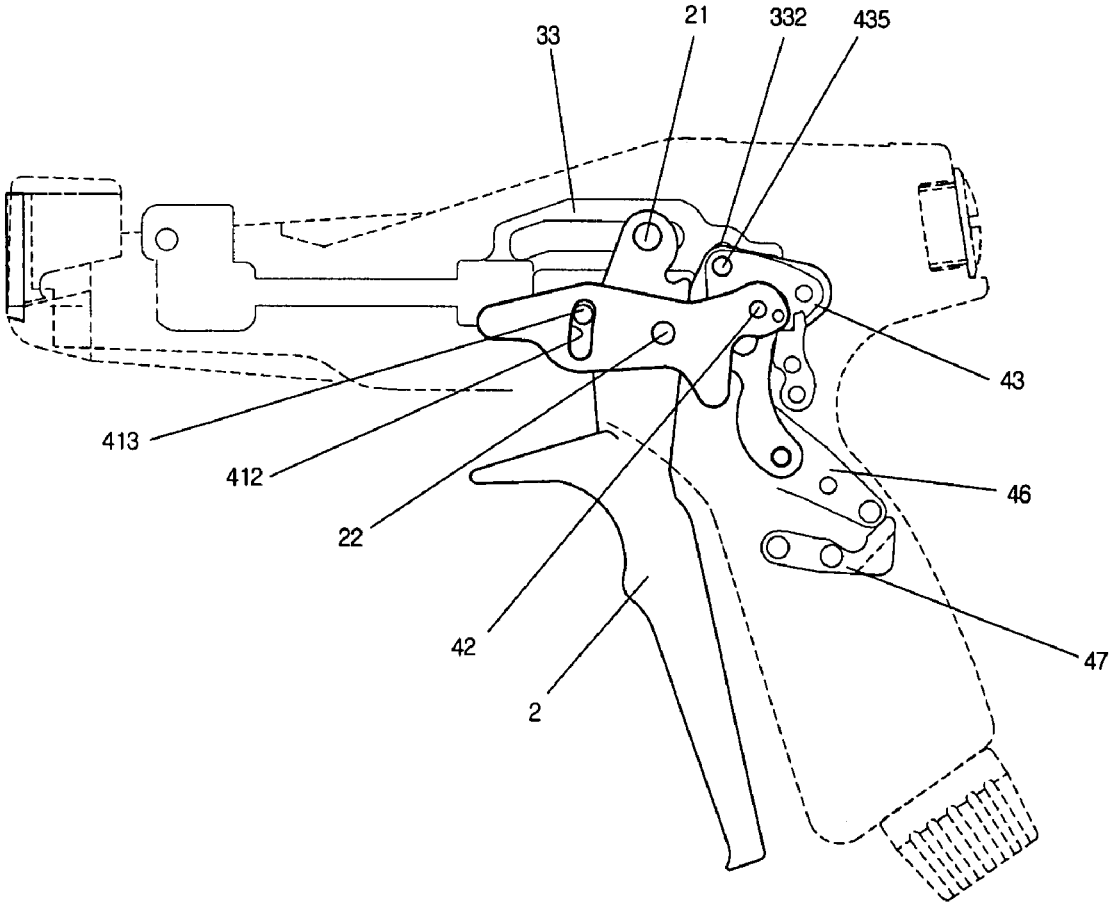
FIGS. 12*a*, 12*b*, 12*c*, 12*d*, and 12*e* are views illustrating the operation of the clutch assembly when the cable tie cutter executes a cutting preparation process.
Figure 12B:
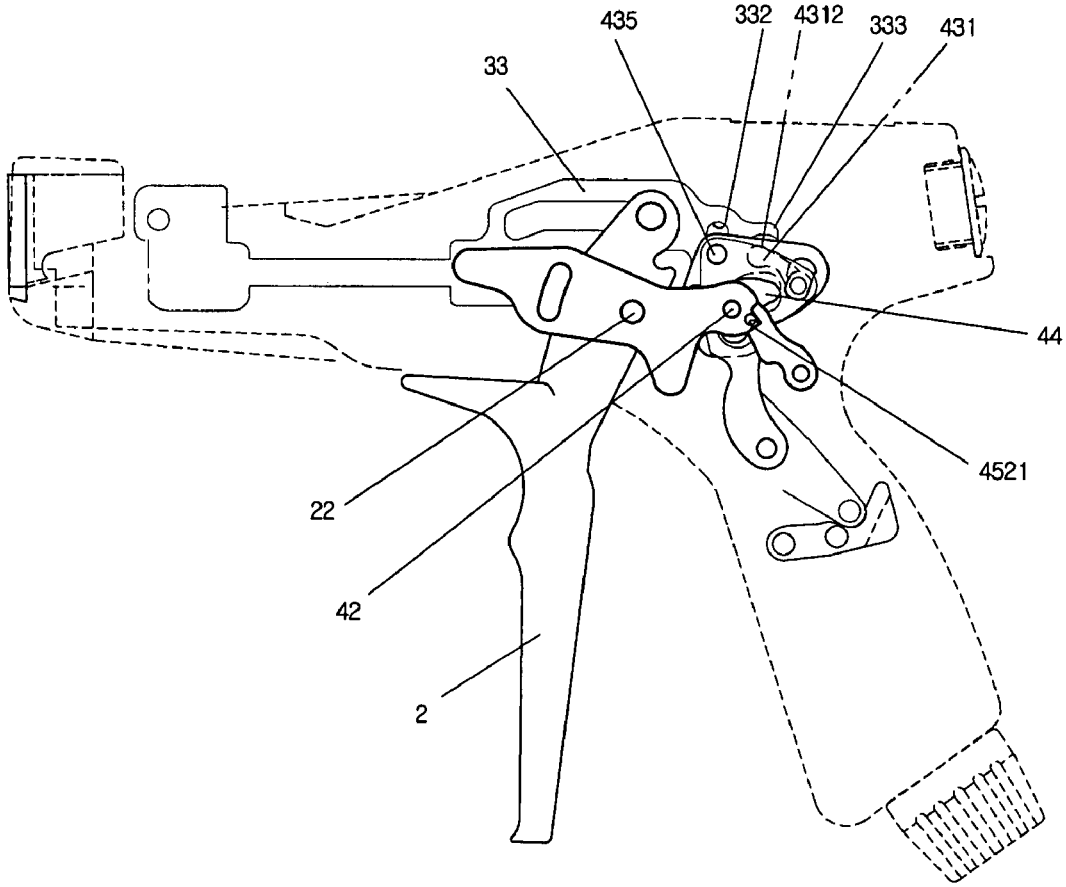
Figure 12C:
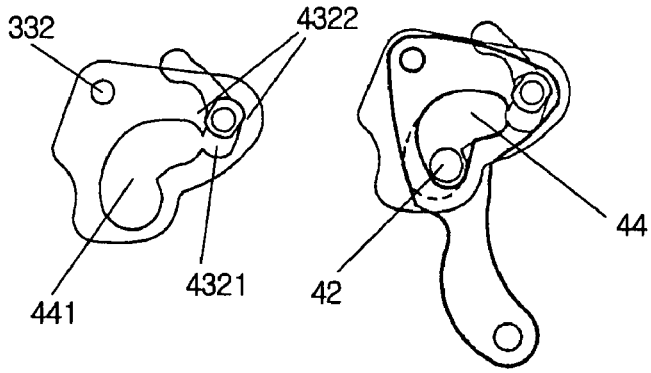
Figure 12D:
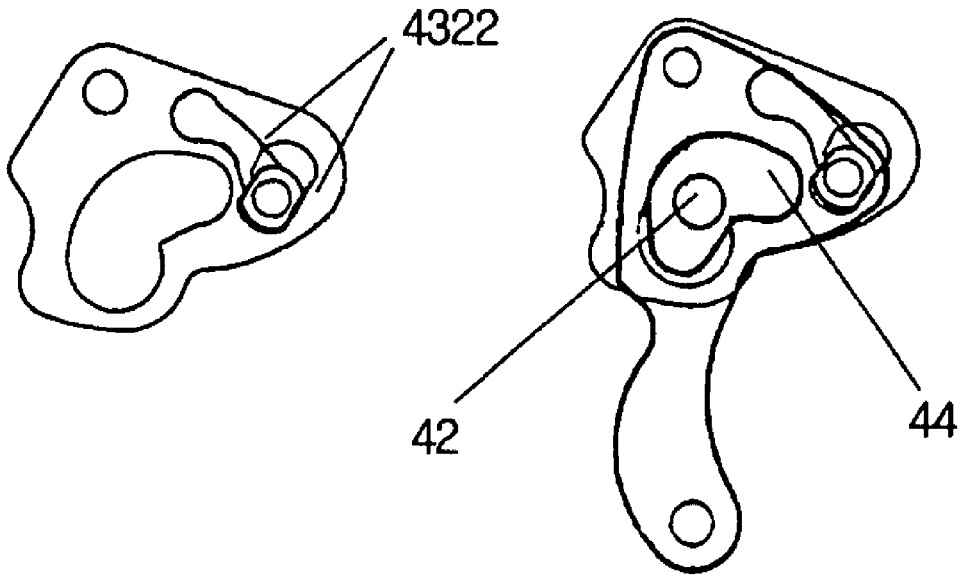
Figure 12E:
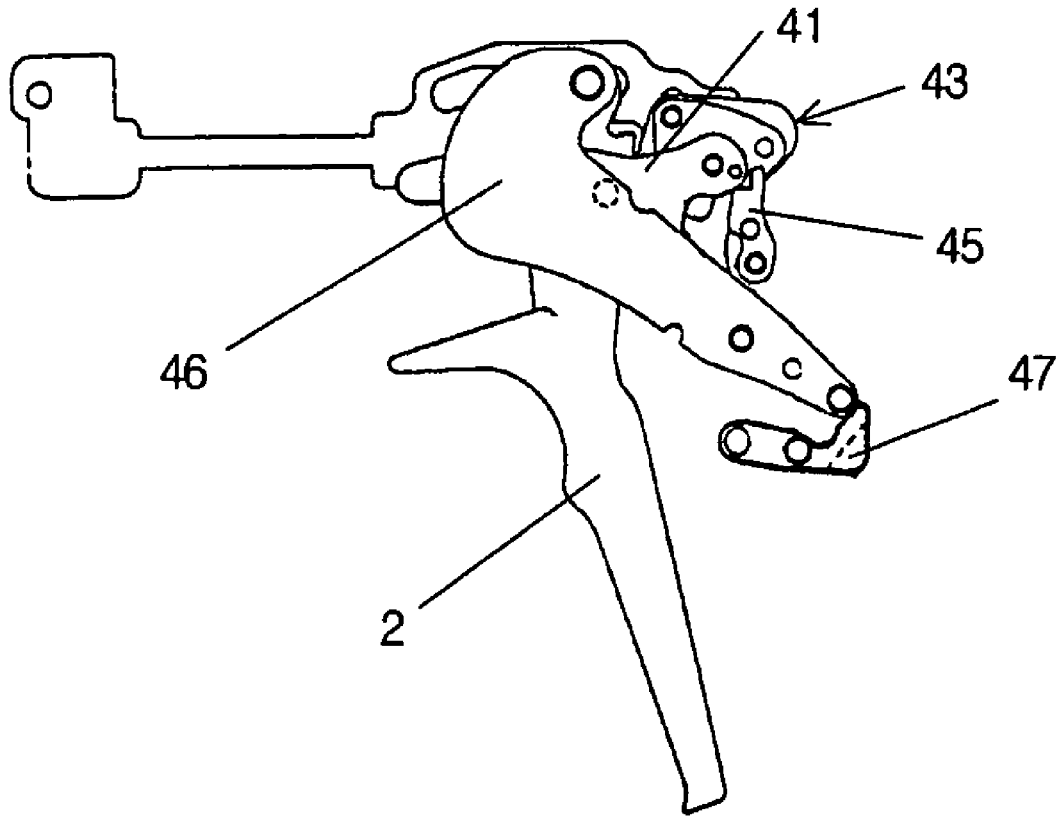
Figure 13A:
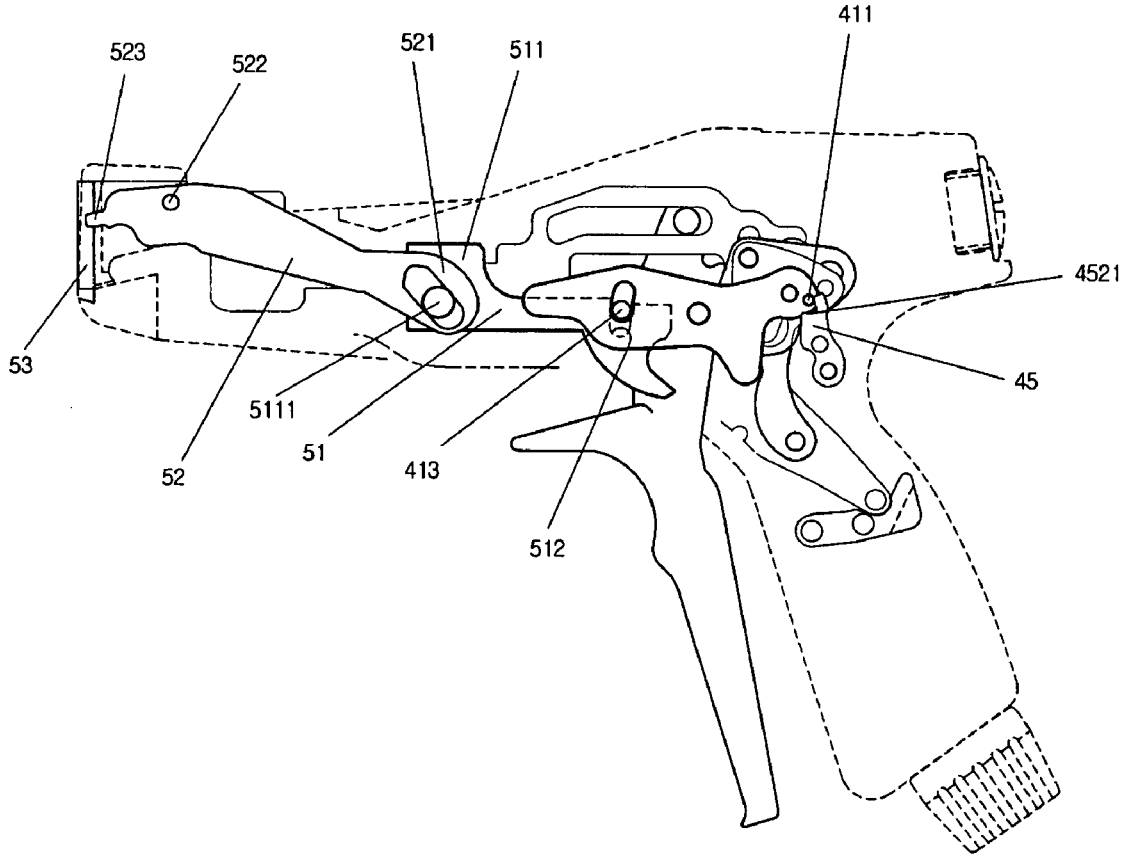
FIGS. 13*a* and 13*b* are views illustrating the operation of the cable tie cutter according to the present invention when the cutter executes a cutting process.
Figure 13B:
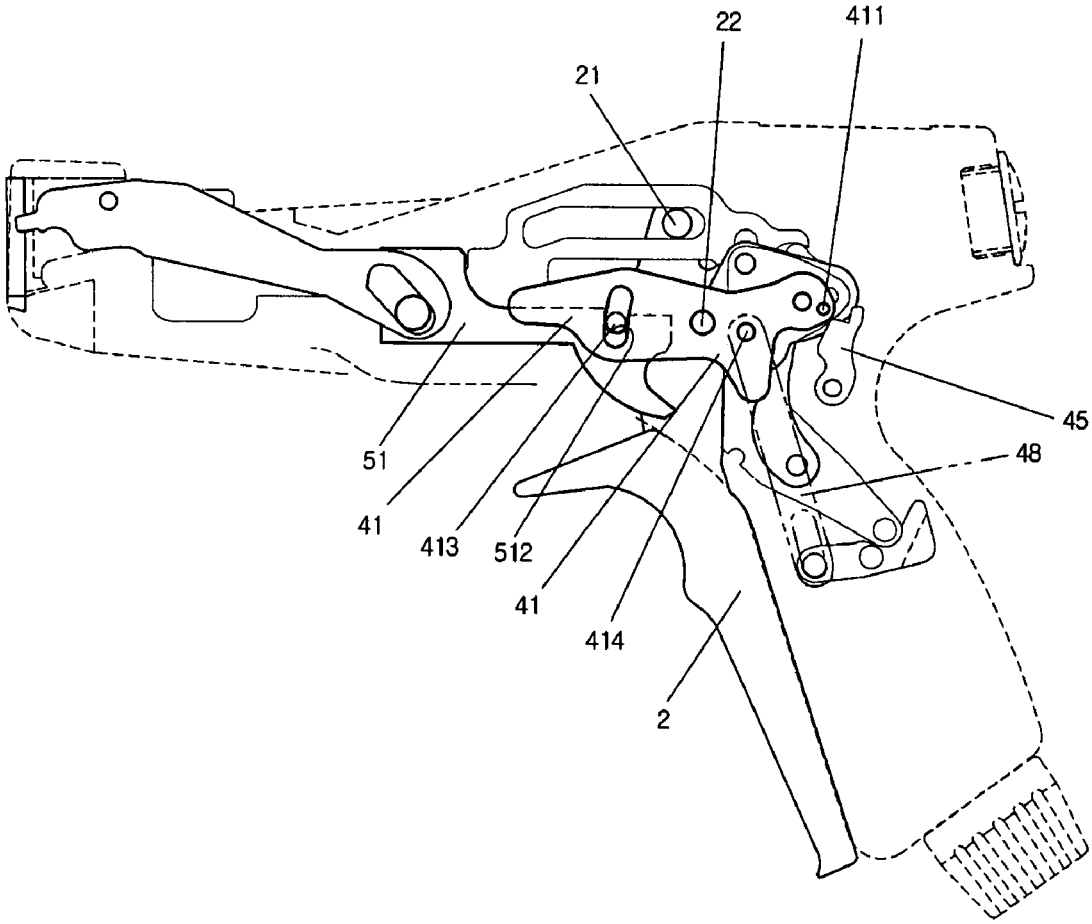

To fasten a plurality of cables (not shown) together using a cable tie T and cut the surplus end of the cable tie T, the end of the cable tie T is inserted into the fixed cable tie holder 311 and the movable cable tie holder 312 through the insertion slot 3111 of the cable tie holder 31 of the cable tie traction means 3. In the above state, as shown in FIG. 11*a*, a user grasps the grip 11 with his/her hand before pressing the trigger lever 2 by fingers. When the user presses the lever 2 backwards by fingers, the lever 2 is retracted so that the clutch connection plate 41 of the clutch means 4, which is hinged to the lever 2 by the hinge pin 22, is horizontally moved backwards (see FIG. 11*b*). In FIG. 11*c*, the dotted lines illustrate the positions of the elements moved from the original positions thereof in the above state and the solid lines illustrate the original positions thereof. When the clutch connection plate 41 is retracted horizontally as described above, the clutch assembly 43, which is operated in conjunction with the clutch connection plate 41 by the actuation pin 42, is rotated backwards around the hinge pin 4332. Further, the traction tension block 33, which is operated in conjunction with the clutch assembly 43 by the connection shaft 435, is retracted backwards. When the traction tension block 33 is retracted backwards as described above, the movable cable tie holder 312, which is integrated with the traction tension block 33, is moved backwards and draws the cable tie backwards. When the trigger lever 2 is released from the fingers in the above state, the lever 2 is elastically returned to its original position by the restoring force of the spring 7, so that the clutch connection plate 41, the clutch assembly 43 and the traction tension block 33, which are operated in conjunction with the lever 2, are returned to their original positions. When the cable tie T is fully tightened by manipulating the lever 2, the cable tie T cannot be further retracted backwards even when the lever 2 is rotated backwards. Thus, the traction tension block 33 is maintained in its stopped state. Further, pressure is generated when the trigger lever 2 is rotated backwards, so that a horizontal retraction force is applied to the clutch connection plate 41, which cooperates with the lever 2. However, because the traction tension block 33 cannot be moved backwards in the above state, the actuation pin 42 pushes the clutch assembly 43 backwards. Thus, the lever 2 is rotated counterclockwise by the hinge shaft 21, so that the clutch connection plate 41, which is connected to the lever 2 by the hinge pin 22, is rotated around the hinge shaft 21. Therefore, the rotating force is applied to both the connection shaft 435 and the hinge pin 4332 of the clutch assembly 43, so that the base plate 46 intends to be rotated counterclockwise. Thus, when the force to rotate the base plate 46 is higher than the spring force of the spring 472, the base plate 46 overcomes the spring force of the spring 472 and is rotated after escaping from the stop slot 471 of the base block 47. Thus, the base block 47 is rotated around the hinge shaft 473. When the base plate 46 is moved relative to the upper edge of the base block 47 as described above (see FIG. 12*a*), the clutch assembly 43 is moved upwards. In other words, when the trigger lever 2 is pressed backwards by the fingers, the base plate 46 is rotated around the hinge shaft 21. Thus, the clutch assembly 43 is moved upwards along the connection hole 332 of the traction tension block 33 by the connection shaft 435. When the clutch assembly 43 is moved upwards, as described above, the link head 4312, which is projected upwards from the clutch link 431 of the clutch disc 432 as shown in FIG. 12*c*, comes into contact with the lower edge of the beak part 333 of the traction tension block 33. Thus, the clutch link 431 is rotated (see FIG. 12*d*), so that the switch protrusion 4311 of the clutch link 431, which is seated in the stop hole 4322 of the slide hole 4321 of the clutch disc 432, is rotated and escapes from the stop hole 4322. Further, in the above state, the clutch disc 432 is rotatable around the connection shaft 435, so that the clutch connection plate 41 is rotated and the actuation pin 42 is rotated to push the stop protrusion 4323, which is placed on the edge of the first actuation hole 441 of the clutch disc 432, upwards and is placed in the middle portion of the actuation hole 44 (see FIG. 12*d*). In the above-mentioned state, the clutch disc 432 stops its rotating motion and is released from the cable tie traction means 3. The above-mentioned counterclockwise rotation of the clutch connection plate 41 around the hinge pin 22 causes the actuation pin 42 to be placed in the middle position of the actuation hole 44 of the clutch assembly 43, so that the clutch assembly 43 is released from the trigger lever 2. However, the link pin 413, which is placed in the actuation hole 412 formed in front of the clutch connection plate 41, is inserted into the guide hole 512 of the carrier 51 of the cutting means 5 when the clutch connection plate 41 is rotated counterclockwise around the hinge pin 22, thus being brought into engagement with the cutting means 5, as shown in FIG. 13*a*. In the above state, the first protrusion 411, which is projected from the first end of the clutch connection plate 41 of the clutch means 4, is placed on the protrusion jaw 4521 of the combination hook 45. When the trigger lever 2 is pressed backwards by the fingers in the state wherein the cutting means 5 engages with the clutch connection plate 41 as described above, the clutch assembly 43 is retracted in a horizontal direction. Thus, the carrier 51, which engages with the link pin 413, is retracted backwards and the sliding part 521 of the actuation link 52, which engages with the bearing 5111 of the guide 511 of the carrier 51, is moved upwards. Thus, the locking protrusion 523 is moved downwards and pushes the cutting blade 53 downwards, thus cutting the cable tie T. As described above, when the clutch connection plate 41 and the carrier 51 are moved backwards in response to the retraction of the lever 2, the combination hook 45, in which the first protrusion 411 is placed, is levered backwards, thus being separated from the first protrusion 411 (see FIG. 13*b*). Thus, the surplus end of the cable tie T is cut and, at the same time, the second protrusion 414 of the clutch connection plate 41 is pulled downwards by the connection plate 48. Therefore, the clutch connection plate 41 is rotated clockwise around the hinge pin 22 and the link pin 413 is removed from the guide hole 512. Further, the clutch assembly 43 is returned to its original position (see FIG. 11*a*), so that the clutch means 4 disengages from the cutting means 5 and is brought into engagement with the cable tie traction means 3. As described above, the cable tie cutter A according to the present invention divides the cable tie cutting force into two steps: the cutting preparation step and the cutting step. Thus, in the cutting preparation step, the user only imposes a small force, which is required to cause the base plate 46 to move along the upper edge of the base block 47, on the cutter A. In the cutting step, the user only imposes a small force, which is required to cut the cable tie T. Thus, the user divides the cutting force into two forces and cuts the cable tie in two steps using respective forces, thereby easily and conveniently cutting the cable tie with a small force.

As apparent from the above description, the cable tie cutting method according to the present invention comprises a cable tie tightening step of repeatedly pressing the trigger lever backwards such that a cable tie traction means, which holds the cable tie, is repeatedly moved backwards, thus drawing the cable tie backwards until the cable tie is tightened to realize a predetermined tightened state thereof; a cable tie cutting preparation step of pressing the trigger lever backwards, thus rotating a clutch means such that the clutch means is released from engagement with the cable tie traction means and is brought into engagement with a cutting means so that the cutting means is operable in conjunction with the clutch means, and a base block is rotated, thus realizing an operational preparation state of the cutting means; a cable tie cutting step of pressing the trigger lever backwards, thus moving the cutting means backwards by the clutch means and operating a cutting blade of the cutting means, and cutting the end of the cable tie by the cutting blade; and a returning step of returning the clutch means to an original state thereof, after cutting the end of the cable tie, such that the clutch means is released from engagement with the cutting means and is brought into engagement with the cable tie traction means such that the cable tie traction means is operated in conjunction with the clutch means. Further, the cable tie cutter of the present invention comprises a trigger lever rotatably mounted at an upper end thereof to a cutter casing by a hinge and pressed backwards; a cable tie traction means coupled to the trigger lever such that the cable tie traction means is operated in conjunction with the trigger lever, the cable tie traction means holding a cable tie and drawing the cable tie backwards to tighten the cable tie; a clutch means operated in conjunction with the cable tie traction means and temporarily stopping the operation of the cable tie traction means when the cable tie is fully drawn and tightened; and a cutting means selectively coupled to the clutch means such that the cutting means is operated in conjunction with the clutch means when the clutch means is released from engagement with the cable tie traction means, the cutting means cutting the cable tie when the trigger lever is pressed backwards, and, thereafter, the cutting means being released from cooperation with the trigger lever. Thus, in the present invention, the cable tie cutting force is divided into two steps: the cutting preparation step and the cutting step. In the cutting preparation step, the user only imposes a small force, which is required to cause the base plate to move along the upper edge of the base block, on the cutter. In the cutting step, the user only imposes a small force, which is required to cut the cable tie. Thus, the user divides the cutting force into two forces and cuts the cable tie in two steps using respective forces, thereby easily and conveniently cutting the cable tie with a small force without damage to the elbow and wrist of a user.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cable tie cutting method of inserting an end of a cable tie into a cable tie cutter and repeatedly pressing a trigger lever of the cutter backwards, thus cutting the end of the cable tie, the method comprising:

a cable tie tightening step of repeatedly pressing the trigger lever backwards such that a cable tie traction means, which holds the cable tie, is repeatedly moved backwards, thus drawing the cable tie backwards until the cable tie is tightened to realize a predetermined tightened state thereof;

a cable tie cutting preparation step of pressing the trigger lever backwards, thus rotating a clutch means such that the clutch means is released from engagement with the cable tie traction means and is brought into engagement with a cutting means so that the cutting means is operable in conjunction with the clutch means, and a base block is rotated, thus realizing an operational preparation state of the cutting means;

a cable tie cutting step of pressing the trigger lever backwards, thus moving the cutting means backwards by the clutch means and operating a cutting blade of the cutting means, and cutting the end of the cable tie by the cutting blade; and a returning step of returning the clutch means to an original state thereof, after cutting the end of the cable tie, such that the clutch means is released from engagement with the cutting means and is brought into engagement with the cable tie traction means such that the cable tie traction means is operated in conjunction with the clutch means.

2. The cable tie cutting method according to claim 1, wherein, in the cable tie tightening step, first and second actuation holes of a clutch disc of a clutch housing of a clutch assembly are located such that the first and second actuation holes are offset from each other, so that a stop protrusion, provided on an edge of the first actuation hole of the clutch disc of the clutch means, projects closer to an actuation pin rather than an extension part of the clutch housing, a link head of a clutch link projects outside an upper edge of the clutch disc, a switch protrusion is locked to a stop hole of a slide hole of the clutch disc, and the rotating motion of the clutch disc is stopped.

3. A cable tie cutter, comprising:

a trigger lever rotatably mounted at an upper end thereof to a cutter casing by a hinge and pressed backwards;

a cable tie traction means coupled to the trigger lever such that the cable tie traction means is operated in conjunction with the trigger lever, the cable tie traction means holding a cable tie and drawing the cable tie backwards to tighten the cable tie;

a clutch means operated in conjunction with the cable tie traction means and temporarily stopping the operation of the cable tie traction means when the cable tie is fully drawn and tightened; and a cutting means selectively coupled to the clutch means such that the cutting means is operated in conjunction with the clutch means when the clutch means is released from engagement with the cable tie traction means, the cutting means cutting the cable tie when the trigger lever is pressed backwards, and, thereafter, the cutting means being released from cooperation with the trigger lever.

4. The cable tie cutter according to claim 3, wherein the cable tie traction means comprises:

a cable tie holder installed in a front part of a barrel of the cutter casing and holds the cable tie; and a traction tension block connected to the cable tie holder through a shaft such that the traction tension block is moved forwards and backwards, with a horizontal slide hole formed in a middle part of the traction tension block, a connection hole formed in a rear part of the traction tension block and connected to the clutch means, and a beak part formed on a rear end of the traction tension block and detachably engaging with the clutch means.

5. The cable tie cutter according to claim 3, wherein the clutch means comprises:

a clutch connection plate rotalably connected to the trigger lever by a hinge pin and operated in conjunction with the trigger lever;

a clutch assembly having an actuation hole and connected to the clutch connection plate by inserting an actuation pin, provided on a rear part of the clutch connection plate, into the actuation hole, thus being operated in conjunction with the clutch connection plate;

a combination hook rotatably mounted to the cutter casing by a hinge and having a curved edge to be operated in conjunction with a first protrusion provided in the rear part of the clutch connection plate; and a base plate connected at a first end thereof to a hinge shaft, and mounted at a second end thereof to the cutter casing such that the base plate is in close contact with a base block, and hinged to the clutch assembly at a middle portion thereof.

6. The cable tie cutter according to claim 5, wherein the clutch connection plate comprises: two plates parallely arranged in the cutter casing such that the two clutch connection plates cover both the trigger lever and the traction tension block at locations outside them, each of the two clutch connection plates comprising an arcuate actuation hole, which extends in a direction perpendicular to an axis of the plate, with a link pin inserted into the actuation hole, and a second protrusion projected outwards at a location between the hinge pin and the actuation pin; and the clutch assembly comprises: a clutch link detachably connected to the beak part of the traction tension block; two clutch discs oppositely placed outside the clutch link to cover the clutch link, with a first actuation bole having a reversed heart shape formed in a middle portion of each of the two clutch discs; and two clutch housings oppositely placed outside the clutch discs to cover the clutch discs, with a second actuation hole having a reversed heart shape formed in the middle portion of each of the two clutch housings and an extension part extending downwards from a lower end of each of the clutch housings and hinged to an associated base plate by a hinge pin, wherein the clutch link, the clutch discs and the clutch housings are connected to each other by a hinge shaft, and upper parts of both the clutch discs and the clutch housings are connected to the traction tension block by a connection shaft, which is inserted into a connection hole of the traction tension block, so that the clutch discs arid the clutch, housings are operated in conjunction with the traction tension block.

7. The cable tie cutter according to claim 5, wherein the base plate is connected at a first end thereof to the hinge shaft, and is connected at a second end thereof to the cutter casing such that the second end is in close contact with a stop slot of the base block, and is hinged at a middle portion thereof to the clutch housing of the clutch assembly; and the base block is hinged to a binge shaft and is elastically biased by a tension spring such that the base block elastically biases a lower end of the base plate upwards.

8. The cable tie cutter according to claim 5, wherein a slide hole is formed through the clutch disc of the clutch assembly such tat the slide hole communicates with the first actuation hole, with a switch protrusion provided on a lower end of the clutch link and connected to the slide hole, and a stop hole formed above the slide hole and connected to the switch protrusion of the clutch link.

9. The cable tie cutter according to claim 5, wherein the combination hook is rotated around a hinge pin and has two extension parts, extending upwards from opposite ends of the combination hook, so that the combination hook is operated in conjunction with the first protrusion, which is provided in the rear part of the clutch connection plate, with a protrusion jaw provided on a curved edge of each of the extension parts, which comes into contact with the first protrusion, and a cooperation plate connected to a middle portion of the combination hook and causing the combination hook to be operated in conjunction with the cutting means, wherein, during a cable tie tightening process, the combination hook comes into contact with the lower end of the curved edge, and during a cable tie cutting preparation process and a cable tie cutting process, the first protrusion is placed on the protrusion jaw of the combination hook.

10. The cable tie cutter according to claim 3, wherein the cutting means comprises:

a movable carrier, with a shaft passing through a first end of the carrier such that the carrier moves along the shaft, a guide having a protruding bearing formed on a side surface of the carrier, a guide hole formed in the second end of the carrier such that the guide hole is open at an upper end thereof and the link pin of the clutch connection plate is inserted into or removed from the guide hole;

an actuation link comprising: a sliding part provided on a first end of the actuation link and having an inclined sliding hole for movably receiving therein the bearing of the guide, the second end of the actuation link being provided with a locking protrusion, which is movable in a vertical direction and engages with a cutting blade movably installed in a fixed cable tie bolder, with a locking protrusion provided on a middle portion of the actuation link and hinged to the cutter casing by a binge pin; and a cutting blade moved in a vertical direction in response to upward or downward movement of the actuation link.

11. The cable tie cutting method according to claim 1, wherein, in the cable tie cutting preparation step, a traction tension block of the cable tie traction means is maintained in a stopped state thereof, and pressure is generated when the trigger lever is pressed backwards, so that a horizontal retraction force is applied to a clutch means plate, which cooperates with the trigger lever, however, a traction tension block cannot be moved, so that the trigger lever is rotated backwards and applies a force to a base plate, and the base plate is rotated after escaping from a base block, and the base block is rotated around a hinge shaft and the base plate is moved along an upper edge of the base block, and a clutch assembly of the clutch means is moved upwards, thus a link head of a clutch link, which is projected upwards from a clutch disc, comes into contact with a lower edge of a beak part of the traction tension block, so that the clutch link is rotated, and a switch protrusion of the clutch link, which is seated in a stop hole of a slide hole of the clutch disc, is rotated and escapes from the stop hole, so that the clutch disc is rotatable around a connection shaft, thereby a clutch connection plate and an actuation pin are rotated to push a stop protrusion, which is placed on an edge of a first actuation hole of the clutch disc, upwards and is placed in a middle portion of the first actuation hole, and the clutch disc stops a rotating motion thereof and is released from the cable tie traction means.

12. The cable tie cutting method according to claim 1, wherein, in the cable tie cutting step, a first protrusion, which is projected from a first end of a clutch connection plate of the clutch means, is placed on a protrusion jaw of a combination hook, and when the trigger lever is pressed backwards while the cutting means engages with the clutch connection plate, a clutch assembly is retracted in a horizontal direction, so that a carrier, which engages with a link pin, is retracted backwards and the sliding part of an actuation link, which engages with a bearing of a guide of a carrier, is moved upwards, thus, a locking protrusion is moved downwards and pushes the cutting blade downwards, thereby cutting the cable tie.

13. The cable tie cutting method according to claim 1, wherein, in the returning step, when a clutch connection plate and a carrier are moved backwards in response to a retraction of the trigger lever, a combination hook, in which a first protrusion is placed, is levered backwards, thus being separated from the first protrusion, so that the end of the cable tie is cut and, at the same time, a second protrusion of the clutch connection plate is pulled downwards by the connection plate, so that the clutch connection plate is rotated clockwise around a hinge pin and a link pin escapes from the guide hole, and the clutch assembly is returned to its original position, so that the clutch means disengages from the cutting means and is brought into engagement with the cable tie traction means.

* * * * *